United States Patent [19]

Johnson et al.

[11] Patent Number: 4,735,145

[45] Date of Patent: Apr. 5, 1988

[54] HIGH TEMPERATURE DETONATOR

[75] Inventors: James O. Johnson; Robert H. Dinegar, both of Los Alamos, N. Mex.

[73] Assignee: The United States of America as represented by the United States Department of Energy, Washington, D.C.

[21] Appl. No.: 20,999

[22] Filed: Mar. 2, 1987

[51] Int. Cl.[4] ..... F42C 11/00; F42C 19/08

[52] U.S. Cl. ..... 102/202.5; 102/202.14; 102/204

[58] Field of Search ..... 102/200, 202.5, 202.14, 102/204, 205

[56] References Cited

U.S. PATENT DOCUMENTS

| | | | |
|---|---|---|---|
| 3,893,395 | 7/1975 | Kilmer | 102/275.4 |
| 3,974,424 | 8/1976 | Lee | 102/202.5 X |
| 3,978,791 | 9/1976 | Lemley et al. | 102/202.14 |
| 4,316,412 | 2/1982 | Dinegar et al. | 102/202.5 |
| 4,671,177 | 6/1987 | Mayville | 102/204 |

OTHER PUBLICATIONS

R. H. Dinegar et al., "All-Secondary Explosive Hot--Wire Devices," Los Alamos National Laboratory Report LA-7897-MS (Oct. 1979).

R. H. Dinegar, "High-Temperature-Stable Detonators," Los Alamos National Laboratory Report LA-U-R-84-0385.

R. H. Dinegar, "Nonprimary-Explosive, Hot-Wire Detonator," Los Alamos National Laboratory Report LA-10173-MS (Oct. 1984).

*Primary Examiner*—Ted L. Parr

*Attorney, Agent, or Firm*—Ray G. Wilson; Paul D. Gaetjens; Judson R. Hightower

[57] ABSTRACT

A detonator assembly is provided which is usable at high temperatures about 300° C. A detonator body is provided with an internal volume defining an anvil surface. A first acceptor explosive is disposed on the anvil surface. A donor assembly having an ignition element, an explosive material, and a flying plate, are placed in the body effective to accelerate the flying plate to impact the first acceptor explosive on the anvil for detonating the first acceptor explosive. A second acceptor explosive is eccentrically located in detonation relationship with the first acceptor explosive to thereafter effect detonation of a main charge.

17 Claims, 2 Drawing Sheets

HIGH TEMPERATURE DETONATOR

BACKGROUND OF THE INVENTION

This invention relates to low-energy detonators for use in initiating an explosion and, more particularly, to low-energy detonator assemblies of relatively insensitive explosives which are stable at high temperatures. This invention is the result of a contract with the Department of Energy (Contract No. W-7405-ENG-36).

Detonator devices usually contain primary explosives which can be initiated by a fuse or a hot wire and which are then used to effect the explosion of more insensitive secondary explosives. Conventionally a primary explosive is selected which requires the addition of energy to be ignited. For example, a wire can be heated to an ignition temperature with the application of a relatively low voltage. Detonators containing primary explosives are often sensitive to stray electrical currents, shock, and heat and their use involves some hazard, particularly in high temperature applications. Indeed, there are no commercially available detonators which can be used at temperatures above about 250° C.

Detonation has been accomplished through a variety of interactions. U.S. Pat. No. 3,978,791, "Secondary Explosive Detonator Device," dated Sept. 7, 1976, to Lemley et al. illustrates a "flying plate" assembly where the ignition of the donor explosive produces gases at a rate which accelerates a disc to impact on a coaxial cylinder of acceptor explosive. The impact of the disc detonates the acceptor explosive. Donor explosive materials are taught to include RDX, PETN, and HMX. Acceptor explosive materials are taught to include a PBNX-5 explosive (a mixture including HMX). The flying plate may be an impactor disc of aluminum or aluminum alloy.

U.S. Pat. No. 4,316,412, "Low Voltage Nonprimary Explosive Detonator," dated Feb. 23, 1982, to Dinegar et al. teaches another means for coupling donor-explosive ignition with an acceptor explosive. A donor-explosive train is provided having a deflagration-to-detonation transition for effecting acceptor detonation. Materials which are disclosed to be useful for the donor charge include PETN, HMX, RDX, and KP.

In many environments it would be desirable to have a detonator which is stable at high temperatures, and preferably at temperatures of at least as high as 300° C. However, many of the explosives which are taught in the prior art for use as donor explosives are not stable at temperatures of 300° C. For example, PETN, RDX, and HMX have melting points below 300° C. Explosives such as HNS and KP might withstand only a limited exposure to temperatures of 300° C.

Robert H. Dinegar, "High-Temperature-Stable Detonators," Los Alamos National Laboratory report LA-UR-84-385 (March 1984) reports the results of using various secondary explosives as donor explosives in hot-wire detonators. The maximum experimental temperature was 250° C. and a conventional flying-plate assembly was used to form the detonator. The report indicates that HMX, KP, HNS, and PYX explosives were investigated for use as a donor explosive. PYX is taught to be ignitable in a hot-wire system and to produce sufficient energy to ignite a PETN acceptor pellet. The report also indicated that PYM might be detonated by a slapper assembly at ambient temperatures. The report then suggests that PYX might be used in a slapper-type detonator at temperatures of +300° C.

Thus, explosive materials which are stable at temperatures above 300° C. are relatively limited and included PYX, NONA, ONT, TNN, and ABH. However, the characteristics of stable explosives are typically opposed to those characteristics most suitable for a detonator. First, stable explosives are relatively insensitive to ignition and low-energy (hot-wire) ignition may not occur. Second, ignition must effect gas generation fast enough to produce an impact on an acceptor explosive which effects detonation.

These and other problems associated with prior art detonator assemblies are overcome by the present invention and a detonator assembly is provided which is usable at high temperatures of at least about 300° C.

One object of the present invention is to provide a detonator assembly of explosives which are stable at temperatures of at least about 300° C.

Another object of the present invention is to provide an effective ignition system for a donor explosive which is stable at high temperatures of at least about 300° C.

One other object of the present invention is to provide an arrangement for detonating an acceptor explosive from the ignition of the relatively stable donor explosive.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a detonator assembly usable at high temperatures. A detonator body is provided with an internal volume defining an anvil surface. A first acceptor explosive is disposed on the anvil surface. Donor means are then placed in the body effective to impact the first acceptor explosive on the anvil for detonating the first acceptor explosive. A second acceptor explosive is placed in detonation relationship with the first acceptor explosive to thereafter effect detonation of a main charge.

In another characterization of the present invention, an improved detonator assembly is provided with a flying- plate donor means for detonating an acceptor explosive in a detonator body. An anvil surface is defined about an axis within the detonator body for accepting a first portion of the acceptor explosive. A flying plate impacts the first portion of the acceptor explosive on the anvil surface for detonating the acceptor explosive.

In one other characterization of the present invention a detonator assembly is formed having a donor explosive which is stable at high temperatures. An improved ignition element enables the relatively stable donor explosive to be ignited and includes a heating element having a serpentine-shaped coil element for ignition contact with the donor explosive.

Yet another characterization of the present invention provides a method for detonating an assembly of donor and acceptor explosives. A first acceptor explosive is disposed on an anvil surface perpendicular to an axis of the explosive assembly. The first acceptor explosive is impacted against the anvil surface with a force which is effective to detonate the first acceptor explosive. The anvil-type impact enables the stable donor explosive to effect detonation of acceptor explosive.

BRIEF DESCRIPTION OF THE DRAWINGS

The accompanying drawings, which are incorporated in and form a part of the specification, illustrate the embodiment of the present invention and, together with the description, serve to explain the principles of the invention. In the drawings.

DETAILED DESCRIPTION OF THE PREFERRED EMBODIMENT

Figure 1:
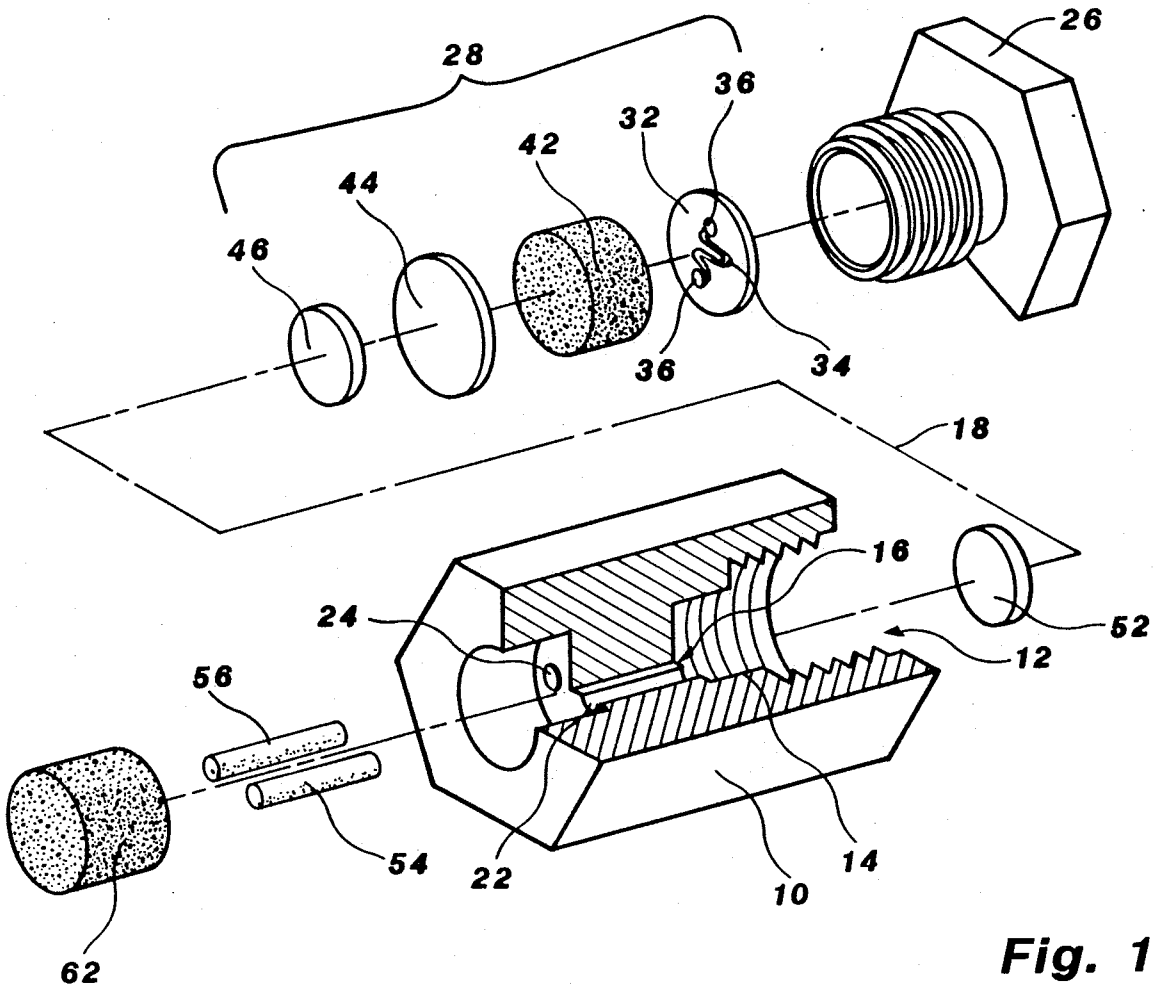
FIG. 1 is an explosed isometric view and partial cutaway showing one embodiment of a detonator according to the present invention.

Referring now to FIG. 1 there is shown an isometric exploded view and partial cutaway of one embodiment of a detonator assembly according to the present invention. Detonator body 10 is provided to hold the various explosive compounds and to define chambers for the detonation events. Donor cavity 12 is provided for accepting a low-energy ignition source and a donor explosive material. Surface 14 forms a barrel through which a plate may be accelerated by the deflagration of the donor material.

In accordance with the present invention anvil surface 16 is provided for use in detonating an acceptor explosive. Detonator body 10 has a central axis 18 and further preferably defines acceptor cylindrical cavity 22 and acceptor cylindrical cavity 24. In accordance with an aspect of the present invention, acceptor cavities 22, 24 are radially displaced from central axis 18.

Cap 26 holds the elements of donor means 28 within donor cavity 12. Heater 32 is generally fixed within cap 26 and includes extending lead elements (not shown). Lead connections 36 on heater 32 supply power to distributed heat source 34. Distributed heat source 34 is preferably of serpentine shape.

Distributed heat source 34 is provided to ignite donor pellet 42. Donor pellet 42 may be formed of an explosive compound which is stable at high temperatures and which may be ignited by distributed heat source 34. As used herein, the term high temperature means a temperature of about 300° C. based on existing materials. In a preferred embodiment of the present invention, donor pellet 42 may be formed from PYX or NONA. The relative insensitivity of these explosives requires that a distributed heat source be used rather than conventional heated wires.

Donor pellet 42 deflagrates to produce gas which forces at least a portion of flying plate 44 through barrel 14 toward anvil surface 16. A first acceptor explosive is provided on anvil surface 16 and above second acceptor explosives 54 and 56 which are placed in acceptor cavities 22 and 24. A cover plate 46 may be provided on first acceptor explosive 52 to hold the explosive in place. Thus, the ignition of donor pellet 42 forces a portion of flying plate 44 through barrel 14 to impact on cover 46 and against first acceptor explosive 52. Acceptor explosive 52 is "squeezed," or shocked, between flying plate 44 and anvil surface 16, effecting the detonation of acceptor explosive 52.

It should be appreciated that a conventional flying-plate detonator was assembled with a stable booster pellet, such as PYX, to accelerate a flying plate into contact with a conventional cylindrical acceptor explosive. The only acceptor explosive which could be detonated was PETN, an explosive which is not stable at temperatures above 300° C. Accordingly, a shock-amplification scheme is provided according to the present invention to effect the detonation of a stable acceptor explosive from the ignition of a suitable stable donor explosive. Anvil surface 16 provides the requisite shock amplification.

As hereinafter discussed, a preferred anvil detonator uses a larger diameter flying plate than conventionally used. In connection with the present invention, conventional acceptor explosives located concentric with axis 18 have been detonated by detonating first acceptor explosive 52 on anvil surface 16. However, detonation does not always occur. It was found that placing acceptor-explosive cylinders 54, 56 at a radial spacing from, i.e., eccentric with, central axis 18 provides for reliable detonation.

The detonation of second acceptor explosives 54, 56 then conventionally ignites booster pellet 62. Booster pellet 62 may again be PYX, which, in turn, detonates a main charge.

Figure 2:
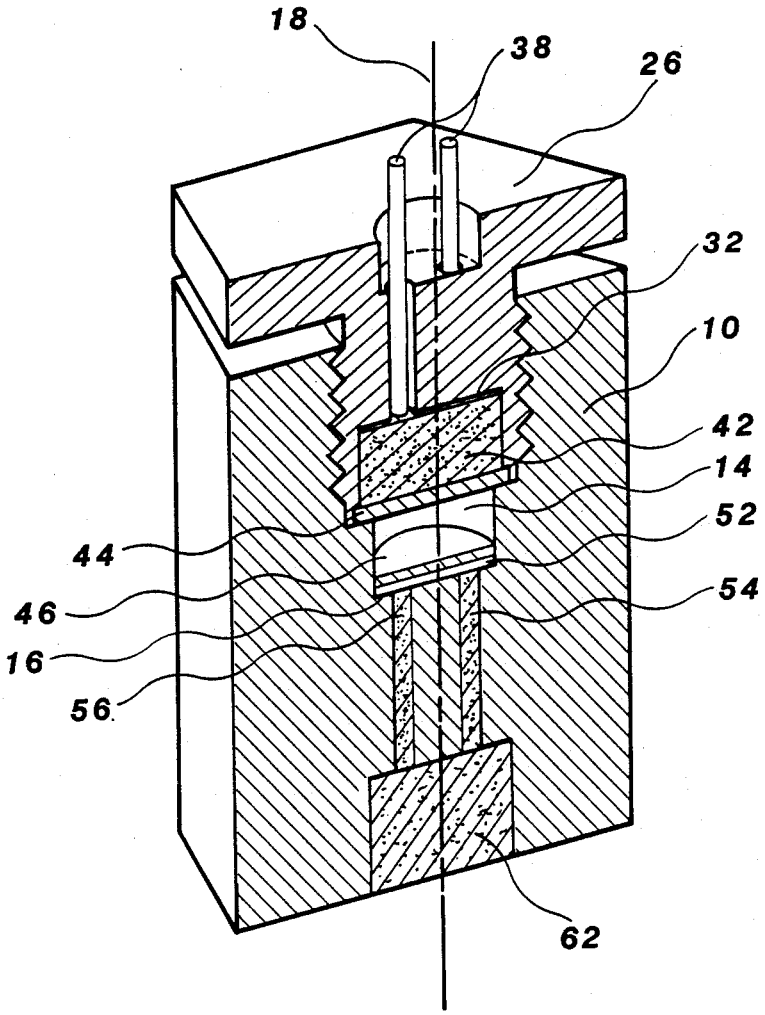
FIG. 2 is a cross section of the assembled detonator depicted in FIG. 1.

Referring now to FIG. 2, there is shown in cross section a detonator assembled from the components depicted in FIG. 1. Body element 10 accepts cap 26, heater 32, donor explosive 42, and flying plate 44. Experiments have shown that the stable PYX explosive can be ignited by a distributed heat source. In a preferred embodiment a relatively large particle PYX ($<2{,}000\ cm^2/g$) is provided. At a loading density of 1.4 $g/cm^3$ a firing current of 4.0/3.0 (all-fire/no-fire) amperes was required. At a loading density of 1.2 $g/cm^3$, a firing current of 3.0/2.5 amperes is required.

To be useful in a detonator, however, donor pellet 42 must ignite fast enough and generate gas effective to do useful work. A donor explosive must produce a detonation reaction in an acceptor explosive and this may be done either by accelerating a flying plate or by a deflagration-to-detonation reaction, both being well-known techniques.

A particular problem arises when using a donor pellet 42 which is stable at high temperatures. Even where the distributed heat source is effective to ignite donor pellet 42, the preferred PYX explosive does not generate gas fast enough to accelerate a flying plate to a velocity effective to directly detonate a preferred acceptor explosive, i.e, NONA. Thus, the present invention provides for impacting an acceptor explosive layer on a surface having a high acoustic impedance with a flying plate having a high acoustic impedance. This "anvil" effect is similar to using a hammer to impact an explosive powder on an anvil surface to produce detonation. It is believed that shock reverberations between the two high acoustic-impedance materials produce an amplification effect sufficient to detonate the first acceptor explosive 52.

Thus, in accordance with the present invention, a relatively thin layer 52 of acceptor explosive, NONA, is placed on anvil surface 16. Flying plate 44 may be formed from stainless steel, but a preferred material is tantalum. The Hugoniot function of tantalum, i.e., the pressure states arising from passage of the shock front through the material, indicates that tantalum will produce a higher impact pressure on the acceptor explosive at a given velocity for the flying plate. A relatively thin stainless steel cover plate may be placed on top of the NONA explosive to hold the explosive in place, but it is an optional element.

It has been shown that the impact of the flying plate 44 on cover plate 46/first acceptor explosive 52 against anvil surface 16 by the ignition of donor explosive 42 detonates first acceptor explosive 52. In a first embodiment of the present invention, first acceptor explosive 52 was placed above a second acceptor explosive in conventional cylindrical form and concentric with central axis 18 of body 10. This arrangement was operable but a significant number of failures were observed.

By placing acceptor explosives 54, 56, at a radial spacing from central axis 18, failures are virtually eliminated. It was found herein that flying plate 44 could assume a curved (convex) shape during transit through barrel 14 such that detonation of acceptor explosive 52 started at a central portion. The curved front of flying plate 44 appears to prevent the resulting detonation from spreading to the main acceptor charge. By moving the acceptor explosive cylinder 54 or 56 to an off-axis location, i.e., radially displaced from axis 18, the trailing edge of the flying plate 44 does not reach the acceptor cylinders 54, 56 until the detonation of first acceptor explosive 52 has spread to the outboard acceptor cylinders 54, 56 and the second acceptor explosives 54, 56 have been initiated to detonation.

A preferred embodiment of the present invention was built according to FIGS. 1 and 2, and having the structural characteristics set out in the Table below.

Detonators according to the above embodiment have been heated to a temperature about 300° C. and successfully fired. Firing of the detonator produced dents in conventional witness blocks which are comparable with dents in witness blocks from conventional low-temperature detonators.

In optimizing the firing conditions for the detonators according to the present invention, firing voltages of 5–10 volts and corresponding firing currents of several amperes were the electrical firing conditions most frequently used. A square wave, short-duration current pulse (less than 100 ms) was operable, but unreliable with respect to igniting the PYX donor explosive at low voltages. A preferred firing current was a ramp-type current increase over a period of several hundred milliseconds. This improved firing characteristic is believed to result from heating the PYX throughout its mass before ignition occurs.

It is believed that the primary aspect of the present invention relating to an anvil resonator for acceptor-explosive detonation is applicable to a variety of explosive materials. Accordingly, the present invention is not limited to application of the preferred explosive materials, PYX and NONA. The invention herein described enables very unresponsive explosive materials to be fired with a low-energy ignition source and to induce detonation of acceptor explosives which have the desired stability.

TABLE

| DESCRIPTION | LENGTH (mm) | THICKNESS (mm) | MASS (mg) | DENSITY (g/cm$^3$) | DIAMETER (mm) | VOLUME (cm$^3$) |
|---|---|---|---|---|---|---|
| DONOR ASSEMBLY 28 | | | | | 8.3 | 0.216 |
| Serpentine Heater Element 34 | 10.6 | 0.051 | | | | |
| Material: Nichrome | | | | | | |
| Explosive 42: | 4.0 | | 260 | 1.2 | 8.3 | 0.216 |
| Large particle PYX | | | | | | |
| FLYING PLATE 44 | | | | | | |
| Material: Tantalum | | 1.0 | | | 8.3 | |
| Barrel 10: Stainless Steel | 5.0 | | | | 6.4 | |
| ANVIL REGION 16 | | | | | | |
| Explosive 52: Fine Particle | | | 4 | 1.2 | | |
| Nonanitroterphenyl (NONA) | | | | | | |
| Cover plate: | | 0.125 | | | 6.4 | |
| Stainless-steel | | | | | | |
| ACCEPTOR CYLINDER 22, 24 | 10.0 | | | | 2.0 | 0.032 |
| Explosive 54,56: | | | | | | |
| Fine Particle | | | | | | |
| Nonanitroterphenyl (NONA) | | | 32 | 1.0 | | |
| BOOSTER PELLET 62 | | | | | | |
| Explosive: PYX | 5.1 | | 370 | 1.6 | 7.6 | 0.231 |

Thus, the foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A detonator assembly, comprising:

body means defining an anvil surface;

a first acceptor explosive disposed on said anvil surface;

donor means, including a donor explosive for effecting an impact on said first acceptor explosive on said anvil for detonation; and a second acceptor explosive in detonation relationship with said first acceptor explosive.

2. A detonator according to claim 1, wherein said donor means includes:

a donor explosive which is stable at a temperature about 300° C.;

a heater having a distributed heat source effective to ignite said donor explosive.

3. A detonator according to claim 2, further including:

a cover plate effective to cover said first acceptor explosive; and a flying plate for acceleration by said donor explosive to impact said cover plate for detonating said first acceptor explosive.

4. A detonator according to claim 3, wherein said distributed heat source is a serpentine shape.

5. A detonator accoding to claim 3, wherein said flying plate is formed from tantalum.

6. A detonator according to claim 2, wherein said booster explosive is PYX.

7. A detonator according to claim 6, wherein said first acceptor explosive is NONA.

8. A detonator according to claim 6, wherein said second acceptor explosive is NONA.

9. A detonator according to claim 1, wherein said donor means includes:

a cover plate effective to cover said first acceptor explosive; and a flying plate for impacting said cover plate to detonate said first acceptor explosive.

10. A detonator according to claim 1, wherein:

said body means further defines a central axis therethrough; and said second acceptor explosive is radially spaced from said central axis.

11. In a detonator assembly having a donor explosive for detonating an acceptor explosive in a detonator body, an improvement comprising:

an anvil surface defined symmetrically about an axis within said body, a first portion of said acceptor explosive disposed on said anvil surface and flying plate means for impacting said first portion of said acceptor explosive on said anvil surface.

12. A detonator according to claim 11, further comprising:

a second portion of said acceptor explosive radially spaced from said axis and in an ignition relationship with said first portion.

13. A detonator according to claim 11, wherein said flying plate means is formed of tantalum.

14. A method for detonating an assembly of donor and acceptor explosives comprising the steps of:

disposing a first acceptor explosive on an anvil surface perpendicular to an axis of said assembly; and igniting said donor explosive to effect an impact on said first acceptor explosive against said anvil surface with a force effective to detonate said first acceptor explosive.

15. A detonation method according to claim 14, further including the step of:

disposing a second acceptor explosive in detonation relationship with said first acceptor explosive and radially spaced from said axis of said assembly.

16. A detonation method according to claim 14, wherein said step of impacting said first acceptor explosive includes the step of accelerating a flying plate toward said first acceptor explosive to detonate said first acceptor explosive.

17. A detonation method according to claim 16, wherein accelerating said flying plate includes the step of igniting PYX explosive with a distributed heat source.

* * * * *